US009019166B2

(12) United States Patent
Puzella et al.

(10) Patent No.: US 9,019,166 B2
(45) Date of Patent: Apr. 28, 2015

(54) ACTIVE ELECTRONICALLY SCANNED ARRAY (AESA) CARD

(75) Inventors: Angelo M. Puzella, Marlborough, MA (US); Patricia S. Dupuis, Medway, MA (US); Craig C. Lemmler, Medway, MA (US); Donald A. Bozza, Billerica, MA (US); Kassam K. Bellahrossi, Pelham, NH (US); James A. Robbins, Groton, MA (US); John B. Francis, Littleton, MA (US)

(73) Assignee: Raytheon Company, Waltham, MA (US)

( * ) Notice: Subject to any disclaimer, the term of this patent is extended or adjusted under 35 U.S.C. 154(b) by 364 days.

(21) Appl. No.: 13/295,437

(22) Filed: Nov. 14, 2011

(65) Prior Publication Data

US 2012/0313818 A1 Dec. 13, 2012

Related U.S. Application Data

(63) Continuation-in-part of application No. 12/484,626, filed on Jun. 15, 2009, now Pat. No. 8,279,131.

(51) Int. Cl.

| | |
|---|---|
| ***H01Q 21/00*** | (2006.01) |
| ***H01Q 1/02*** | (2006.01) |
| ***H01Q 9/04*** | (2006.01) |
| ***H01Q 21/06*** | (2006.01) |

(52) U.S. Cl.

CPC ..... *H01Q 21/00* (2013.01); *H01Q 1/02* (2013.01); *H01Q 9/0414* (2013.01); *H01Q 21/0025* (2013.01); *H01Q 21/0087* (2013.01); *H01Q 21/065* (2013.01)

(58) Field of Classification Search

CPC .. H01Q 3/2605; H01Q 3/2676; H01Q 2/0025
USPC ..... 343/700 MS, 850, 853; 342/371
See application file for complete search history.

(56) References Cited

U.S. PATENT DOCUMENTS

| | | | |
|---|---|---|---|
| 3,091,743 | A | 5/1963 | Wilkinson |
| 3,665,480 | A | 5/1972 | Fassett |

(Continued)

FOREIGN PATENT DOCUMENTS

| | | |
|---|---|---|
| EP | 0 481 417 A | 4/1992 |
| EP | 0 702 424 | 3/1996 |

(Continued)

OTHER PUBLICATIONS

PCT Notification of Transmittal of the International Search Report and the Written Opinion of the International Searching Authority, or the Declaration, PCT/US2012/062542, date of mailing Dec. 14, 2012, 4 pages.

(Continued)

*Primary Examiner* — Dieu H Duong
(74) *Attorney, Agent, or Firm* — Daly, Crowley, Mofford & Durkee, LLP

(57) ABSTRACT

In one aspect, an active electronically scanned array (AESA) card includes a printed wiring board (PWB) that includes a first set of metal layers used to provide RF signal distribution, a second set of metal layers used to provide digital logical distribution, a third set of metal layers used to provide power distribution and a fourth set of metal layers used to provide RF signal distribution. The PWB comprises at least one transmit/receive (T/R) channel used in an AESA.

20 Claims, 5 Drawing Sheets

(56) References Cited

U.S. PATENT DOCUMENTS

| | | | | |
|---|---|---|---|---|
| 4,489,363 | A | 12/1984 | Goldberg | |
| 4,527,165 | A | 7/1985 | deRonde | |
| 4,698,663 | A | 10/1987 | Sugimoto et al. | |
| 4,706,094 | A | 11/1987 | Kubick | |
| 4,751,513 | A | 6/1988 | Daryoush et al. | |
| 4,835,658 | A | 5/1989 | Bonnefoy | |
| 5,005,019 | A | 4/1991 | Zaghloul et al. | |
| 5,055,852 | A | 10/1991 | Dusseux et al. | |
| 5,099,254 | A | 3/1992 | Tsukii et al. | |
| 5,276,455 | A | 1/1994 | Fitzsimmons et al. | |
| 5,398,010 | A | 3/1995 | Klebe | |
| 5,400,040 | A | 3/1995 | Lane et al. | |
| 5,404,148 | A | 4/1995 | Zwarts | |
| 5,451,969 | A | 9/1995 | Toth et al. | |
| 5,459,474 | A | 10/1995 | Mattioli et al. | |
| 5,488,380 | A | 1/1996 | Harvey et al. | |
| 5,493,305 | A | 2/1996 | Wooldridge et al. | |
| 5,563,613 | A | 10/1996 | Schroeder et al. | |
| 5,592,363 | A | 1/1997 | Atarashi et al. | |
| 5,646,826 | A | 7/1997 | Katchmar | |
| 5,675,345 | A | 10/1997 | Pozgay et al. | |
| 5,724,048 | A | 3/1998 | Remondiere | |
| 5,786,792 | A | 7/1998 | Bellus et al. | |
| 5,796,582 | A | 8/1998 | Katchmar | |
| 5,854,607 | A | 12/1998 | Kinghorn | |
| 5,907,304 | A | 5/1999 | Wilson et al. | |
| 6,011,507 | A | 1/2000 | Curran et al. | |
| 6,034,633 | A * | 3/2000 | Cassen et al. | 342/175 |
| 6,037,903 | A | 3/2000 | Lange et al. | |
| 6,061,027 | A | 5/2000 | Legay et al. | |
| 6,078,289 | A | 6/2000 | Manoogian et al. | |
| 6,087,988 | A | 7/2000 | Pozgay | |
| 6,091,373 | A | 7/2000 | Raguenet | |
| 6,104,343 | A | 8/2000 | Brookner et al. | |
| 6,127,985 | A | 10/2000 | Guler | |
| 6,166,705 | A | 12/2000 | Mast et al. | |
| 6,181,280 | B1 | 1/2001 | Kadambi et al. | |
| 6,184,832 | B1 | 2/2001 | Geyh et al. | |
| 6,208,316 | B1 | 3/2001 | Cahill | |
| 6,211,824 | B1 | 4/2001 | Holden et al. | |
| 6,218,214 | B1 | 4/2001 | Panchou et al. | |
| 6,222,493 | B1 | 4/2001 | Caille et al. | |
| 6,225,695 | B1 | 5/2001 | Chia et al. | |
| 6,297,775 | B1 | 10/2001 | Haws et al. | |
| 6,388,620 | B1 | 5/2002 | Bhattacharyya | |
| 6,392,890 | B1 | 5/2002 | Katchmar | |
| 6,424,313 | B1 | 7/2002 | Navarro et al. | |
| 6,480,167 | B2 | 11/2002 | Matthews | |
| 6,483,705 | B2 | 11/2002 | Snyder et al. | |
| 6,611,180 | B1 | 8/2003 | Puzella et al. | |
| 6,621,470 | B1 | 9/2003 | Boeringer et al. | |
| 6,624,787 | B2 | 9/2003 | Puzella et al. | |
| 6,661,376 | B2 | 12/2003 | Maceo et al. | |
| 6,670,930 | B2 | 12/2003 | Navarro | |
| 6,686,885 | B1 | 2/2004 | Barkdoll et al. | |
| 6,703,976 | B2 | 3/2004 | Jacomb-Hood et al. | |
| 6,711,814 | B2 | 3/2004 | Barr et al. | |
| 6,731,189 | B2 | 5/2004 | Puzella et al. | |
| 6,756,684 | B2 | 6/2004 | Huang | |
| 6,856,210 | B2 | 2/2005 | Suematsu et al. | |
| 6,900,765 | B2 | 5/2005 | Navarro et al. | |
| 6,943,330 | B2 | 9/2005 | Ring | |
| 6,961,248 | B2 | 11/2005 | Vincent et al. | |
| 6,995,322 | B2 | 2/2006 | Chan et al. | |
| 7,030,712 | B2 | 4/2006 | Brunette et al. | |
| 7,061,446 | B1 | 6/2006 | Short, Jr. et al. | |
| 7,129,908 | B2 | 10/2006 | Edward et al. | |
| 7,132,990 | B2 | 11/2006 | Stenger et al. | |
| 7,180,745 | B2 | 2/2007 | Mandel et al. | |
| 7,187,342 | B2 | 3/2007 | Heisen et al. | |
| 7,298,235 | B2 | 11/2007 | Hauhe et al. | |
| 7,348,932 | B1 | 3/2008 | Puzella et al. | |
| 7,417,598 | B2 | 8/2008 | Navarro et al. | |
| 7,436,210 | B2 | 10/2008 | Venkata et al. | |
| 7,443,354 | B2 | 10/2008 | Navarro et al. | |
| 7,444,737 | B2 | 11/2008 | Worl | |
| 7,489,283 | B2 | 2/2009 | Ingram et al. | |
| 7,508,338 | B2 | 3/2009 | Pluymers et al. | |
| 7,597,534 | B2 | 10/2009 | Hopkins | |
| 7,671,696 | B1 | 3/2010 | Puzella et al. | |
| 7,884,768 | B2 * | 2/2011 | Navarro et al. | 343/702 |
| 2002/0051342 | A1 | 5/2002 | Kanada | |
| 2003/0067410 | A1 | 2/2004 | Barkdoll et al. | |
| 2005/0110681 | A1 | 5/2005 | Londre | |
| 2005/0151215 | A1 | 7/2005 | Hauhe et al. | |
| 2006/0268518 | A1 | 11/2006 | Edward et al. | |
| 2007/0030681 | A1 | 2/2007 | Farrell et al. | |
| 2007/0152882 | A1 | 7/2007 | Hash et al. | |
| 2008/0074324 | A1 | 3/2008 | Puzella et al. | |
| 2008/0106467 | A1 | 5/2008 | Navarro et al. | |
| 2008/0106482 | A1 | 5/2008 | Cherrette et al. | |
| 2008/0150832 | A1 | 6/2008 | Ingram et al. | |
| 2008/0316139 | A1 | 12/2008 | Blaser et al. | |

FOREIGN PATENT DOCUMENTS

| | | | |
|---|---|---|---|
| EP | 1 764 863 | A1 | 3/2007 |
| EP | 1 436 859 | B1 | 8/2007 |
| EP | 1 978 597 | A1 | 10/2008 |
| JP | 61224504 | | 10/1986 |
| JP | 4-122107 | A | 4/1992 |
| JP | 2006-097710 | | 4/1994 |
| JP | 2007-21215 | | 8/1995 |
| JP | 8-97633 | | 4/1996 |
| JP | 11-340724 | | 12/1999 |
| JP | 2000-138525 | A | 5/2000 |
| JP | 2002-335116 | | 11/2002 |
| JP | 2003179429 | A | 6/2003 |
| JP | 2005 505963 | | 2/2005 |
| JP | 2007-504749 | | 3/2007 |
| KR | 1020010079872 | A | 8/2001 |
| WO | WO 98/26642 | | 6/1998 |
| WO | WO 99/66594 | | 12/1999 |
| WO | WO 01/06821 | A1 | 1/2001 |
| WO | WO 01/20720 | A1 | 3/2001 |
| WO | WO 01/33927 | A1 | 5/2001 |
| WO | WO 01/41257 | A1 | 6/2001 |
| WO | WO 03/030301 | A1 | 4/2003 |
| WO | WO 2005/025001 | | 3/2005 |
| WO | WO 2007/136941 | A2 | 11/2007 |
| WO | WO 2007/136941 | A3 | 11/2007 |
| WO | WO 2008/010851 | A2 | 1/2008 |
| WO | WO 2008/010851 | A3 | 1/2008 |
| WO | WO 2008/036469 | | 3/2008 |
| WO | WO 2008/036469 | A1 | 3/2008 |
| WO | WO 2008036469 | A1 | 8/2008 |

OTHER PUBLICATIONS

PCT Written Opinion of the International Searching Authority, PCT/US2012/062542, date of mailing Dec. 14, 2012, 6 pages.

PCT Communication in Cases for Which No Other Form is Applicable, date of mailing Jan. 21, 2013, 1 page.

PCT Written Opinion of the International Searching Authority, PCT/US2012/062542, Jan. 21, 2013, 2 pages.

EP Response to the Communication pursuant to Rule 161(1) and 162 EPC, filed on May 24, 2012, 30 pages.

Office Action dated Apr. 19, 2013; for JP Pat. Appl. No. 2012-502088, 5 pages.

Response to Office Action from Japanese Patent Office dated Apr. 19, 2013 as filed on Jul. 19, 2013 for Application No. 2012-502088.

Examiner's Report dated Jul. 15, 2013 from Canadian Patent Office for Application No. 2,753,518.

Response to Examiner's Report dated Jul. 15, 2013 from Canadian Patent Office as filed on Dec. 20, 2013 for Application No. 2,753,518.

EPO Notice of intention to Grant dated Feb. 28, 2013 for Application No. 10 713 384.5.

EPO Response to Notice of Intention to Grant dated Feb. 28, 2013 as filed on Jun. 28, 2013 for Application No. 10 713 384.5.

Allowance Decision of Examination dated Dec. 18, 2013 from Taiwanese Patent Office for Application No. 099107808.

(56) References Cited

OTHER PUBLICATIONS

Allowance Report dated Aug. 12, 2013 from Japanese Patent Office for Application No. 2012-502088.
Office Action and Translation dated Aug. 12, 2013.
Response to Office Action filed on Oct. 18, 2013.
Bash et al,; "Improving Heat Transfer From a Flip-Chip Package;" Technology Industry; Email Alert RSS Feed; Hewlett-Packard Journal, Aug. 1997; 3 pages.
Carter; "'Fuzz Button' interconnects and microwave and mm-wave frequencies;" IEEE Seminar, London, UK; Mar. 1-7, 2000; 7 pages.
Decision of Rejection dated Jul. 30, 2008 from KR Pat. App. No. 10-2004-7003900.
Div. Application (with translation of amended claims) as filed on Dec. 1, 2008 and assigned App. No. 10-2008-7029396.
EP Search Report for 06021905.2; dated Feb. 9, 2007; 8 pages.
European Office Action dated Oct. 18, 2007 from EPO Pat. App. No. 06021905.2.
European Office Action dated Feb. 18, 2010 from EPO Pat. App. No. 06021905.2.
European Office Action dated Nov. 3, 2006 from EP Pat. App. No. 02800372.1.
International Preliminary Report on Patentability of the ISA for PCT/US2010/026861 dated Oct. 6, 2011.
Japanese Office Action dated Feb. 15, 2008 from JP Pat. App. No. 2003-533378.
Japanese Office Action dated Feb. 18, 2009 from JP Pat. App. No. 2003-533378.
Japanese Office Action dated Mar. 7, 2007 from JP Pat. App. No. 2003-533378.
Jerinic et al.; "X-Band "Tile" Array for Mobil Radar;" internal Raytheon Company publication; Spring 2003; 4 pages.
Korean Office Action dated Oct. 31, 2007 from KR Pat. App. No. 10-2004-7003900.
Korean Office Action dated Nov. 27, 2009 from KR Pat. App. No. 10-2008-7029396.
Korean Office Action dated Feb. 25, 2009 from KR Pat. App. No. 10-2008-7029396.
Marsh et al.; "5.4 Watt GaAs MESFET MMIC for Phased Array Radar Systems;" 1997 Workshop on High Performance Electron Devices for Microwave and Optoelectronic Applications, Nov. 24-25, 1997; pp. 169-174.
Notice of Allowance dated Feb. 2, 2007 from EP Pat. App. No. 02800372.1.
Notice of Allowance dated Nov. 3, 2010 from U.S. Appl. No. 12/482,061.
Notice of Trial Decision dated Mar. 23, 2010 from KR Pat. App. No. 10-2004-7003900.
Office Action dated Jun. 11, 2010 from U.S. Appl. No. 12/694,450.
Office Action dated Mar. 23, 2011 from U.S. Appl. No. 12/694,450.
PCT International Preliminary Examination Report and Written Opinion of the ISA for PCT/US2002/30677 dated Nov. 27, 2003; 10 pages.
PCT International Preliminary Examination Report and Written Opinion of the ISA for PCT/US2007/074795 dated Apr. 2, 2009; 7pages.
PCT Search Report of the ISA for PCT/US2007/074795 dated Dec. 19, 2007; 5 pages.
PCT Search Report of the ISA for PCT/US2010/026861 dated Jun. 18, 2010; 6 pages.
PCT Search Report of the ISA for PCT/US2010/049261 dated Feb. 7, 2011 Written Opinion of the ISA for PCT/US2010/049261 dated Feb. 7, 2011.
PCT Written Opinion of the ISA for PCT/US2007/074795 dated Dec. 19, 2007; 5 pages.
PCT Written Opinion of the ISA for PCT/US2010/026861 dated Jun. 18, 2010; 5 pages.
Puzella et al.; "Digital Subarray for Large Apertures;" slide presentation; internal Raytheon Company publication; Spring 2003; pp. 1-22.
Puzella et al.; "Radio Frequency Interconnect Circuits and Techniques;" U.S. Appl. No. 11/558,126, filed Nov. 9, 2006; 57 pages.
Response to European Office Action dated Oct. 18, 2007 filed in the EPO on Aug. 11, 2008 from EP Pat. App. No. 06021905.2.
Response to European Office Action dated Mar. 19, 2009 filed in the EPO on Nov. 19, 2009 from EP Pat. App. No. 06021905.2.
Response to European Office Action filed Jan. 12, 2007 from EP Pat. App. No. 02800372.1.
Response to Japanese Office Action filed Jul. 5, 2007 from JP App. No. 2003-533378.
Response to Japanese Office Action filed Jun. 19, 2009 from App JP App. No. 2003-533378.
Response to Korean Office Action filed Mar. 26, 2008 from KR Pat. App. No. 10-2004-7003900.
Response to Office Action of Dec. 1, 2010 from U.S. Appl. No. 12/694,450 dated Jan. 25, 2011.
Response to Office Action of Jun. 11, 2010 from U.S. Appl. No. 12/694,450 dated Sep. 21, 2010.
PCT Notification Concerning Transmittal of International Preliminary Report on Patentability of the ISA for PCT/US2012/062542 dated May 30, 2014 2 pages.
PCT Written Opinion of the International Searching Authority of the ISA for PCT/US2012/062542 dated May 30, 2014, 5 pages.
Office Action dated Jan. 9, 2014 for CA Pat. Appl. No. 2,663,800 3 pages.
Examiner's Report dated Oct. 17, 2014 from the Patent Office of the Cooperation Council for the Arab States of the Gulf corresponding to Appl. No. GC 2010-15500; 4 Pages.
Australian Examination Report dated Jan. 12, 2015 corresponding to Patent Appl. No. 2012340002; 3 Pages.
Taiwan Office Action (w/English Translation) dated Feb. 11, 2015 corresponding to Taiwan Patent Appl. No. 101141364; 15 Pages.

* cited by examiner

ACTIVE ELECTRONICALLY SCANNED ARRAY (AESA) CARD

RELATED APPLICATIONS

This patent application is a continuation-in-part to application Ser. No. 12/484,626, filed Jun. 15, 2009 and titled "PANEL ARRAY," which is incorporated herein in its entirety.

BACKGROUND

As is known in the art, a phased array antenna includes a plurality of active circuits spaced apart from each other by known distances. Each of the active circuits is coupled through a plurality of phase shifter circuits, amplifier circuits and/or other circuits to either or both of a transmitter and receiver. In some cases, the phase shifter, amplifier circuits and other circuits (e.g., mixer circuits) are provided in a so-called transmit/receive (T/R) module and are considered to be part of the transmitter and/or receiver.

The phase shifters, amplifier and other circuits (e.g., T/R modules) often require an external power supply (e.g., a DC power supply) to operate correctly. Thus, the circuits are referred to as "active circuits" or "active components." Accordingly, phased array antennas which include active circuits are often referred to as "active phased arrays." An active phased array radar is also known as an active electronically scanned array (AESA).

Active circuits dissipate power in the form of heat. High amounts of heat can cause active circuits to be inoperable. Thus, active phased arrays should be cooled. In one example heat-sink(s) are attached to each active circuit to dissipate the heat.

SUMMARY

In one aspect, an active electronically scanned array (AESA) card includes a printed wiring board (PWB) that includes a first set of metal layers used to provide RF signal distribution, a second set of metal layers used to provide digital logical distribution, a third set of metal layers used to provide power distribution and a fourth set of metal layers used to provide RF signal distribution. The PWB comprises at least one transmit/receive (T/R) channel used in an AESA.

In another aspect, an active electronically scanned array (AESA) assembly includes an AESA card that includes a printed wiring board (PWB). The PWB includes a first set of metal layers used to provide RF signal distribution, a second set of metal layers used to provide digital logical distribution, a third set of metal layers used to provide power distribution and a fourth set of metal layers used to provide RF signal distribution. The PWB also includes one or more monolithic microwave integrated circuits (MMICs) disposed on the surface of the PWB. The PWB includes at least one transmit/receive (T/R) channel used in an AESA.

DETAILED DESCRIPTION

Previous approaches to integrating active Monolithic Microwave Integrated Circuits (MMIC) for each active electronically scanned array (AESA) Transmit/Receive (T/R) Channel included disposing these components in a metal container (sometimes called a "T/R Module"), which results in an expensive assembly. In addition to high material and test labor costs, extensive non-recurring engineering (NRE) is required for changes in AESA architecture (e.g., changes in active aperture size, lattice changes, number of T/R channels per unit cell and so forth) or cooling approach. These previous approaches also use wire bonds that are used for radio frequency (RF), power and logic signals for the T/R module; however, RF wire bonds can cause unwanted electromagnetic coupling between T/R channels or within a T/R channel.

Described herein is a new T/R Channel architecture, an AESA card. The AESA card reduces assembly recurring cost and test time and significantly reduces NRE for new applications or the integration of new MMIC technologies into AESA applications. The AESA card may be fabricated using fully automated assembly process and allows for ease of modifying lattice dimensions and the number of T/R channel cells per assembly. The AESA card includes no wire bonds thereby significantly reducing if not eliminating electromagnetic coupling between T/R channels or within a T/R channel and other electromagnetic interference (EMI). Thus, there is consistent channel-to-channel RF performance.

Figure 1A:
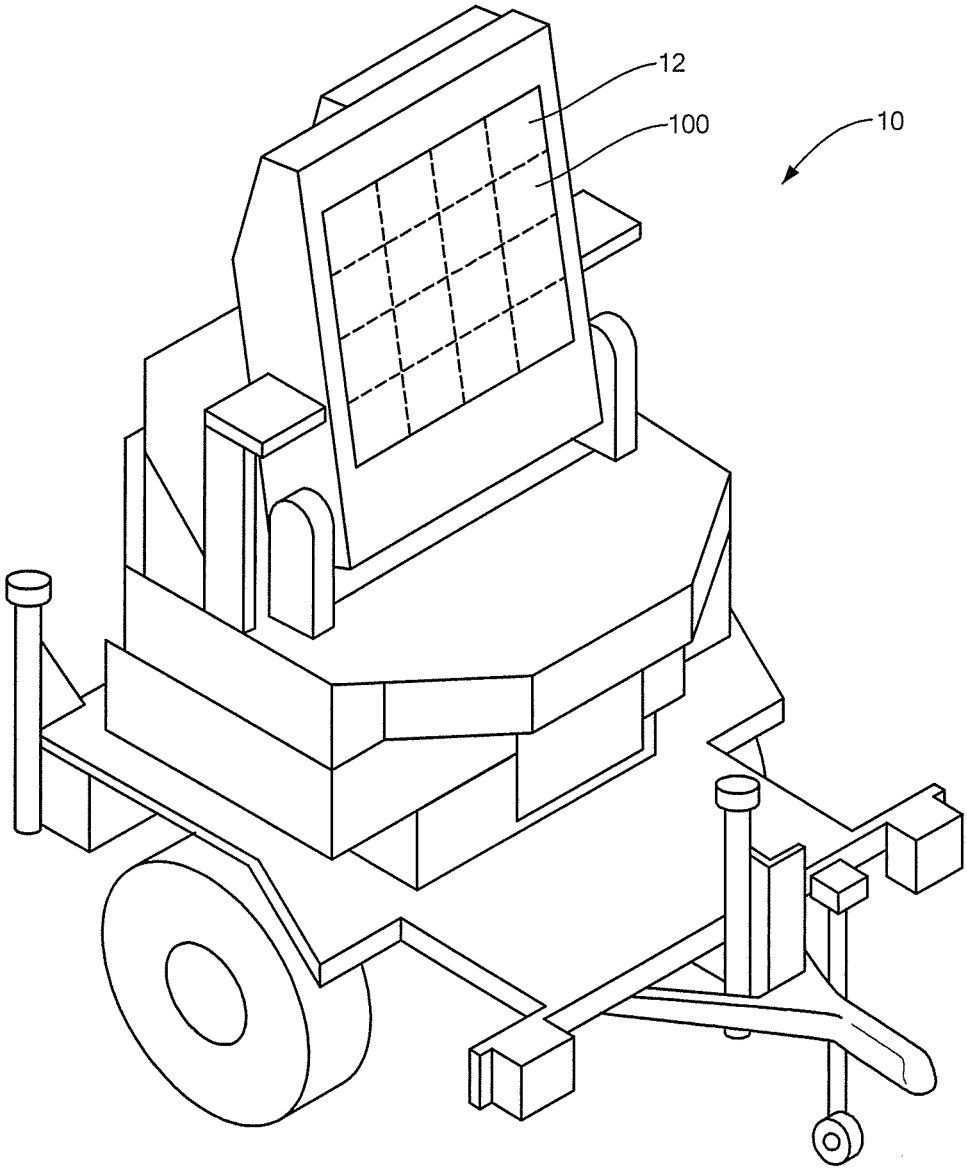
FIG. 1A is a diagram of an active electronically scanned array (AESA) with an array of active electronically scanned array (AESA) cards disposed on a mobile platform.
Figure 1B:
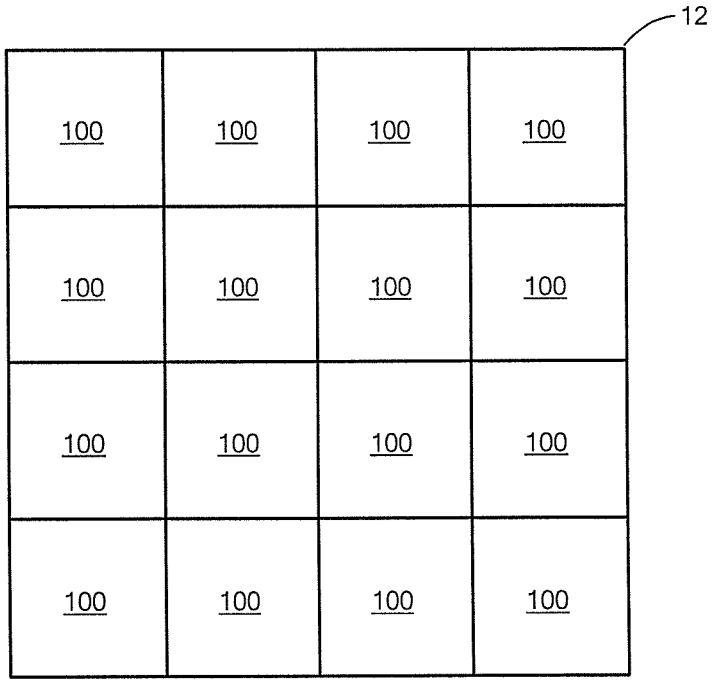
FIG. 1B is a diagram of the array of AESA cards in FIG. 1A.

Referring to FIGS. 1A and 1B, an AESA card may be used in a number of applications. For example, as shown in FIG. 1A, an array 12 of AESA cards 100 may be used in a mobile environment such as in a mobile platform unit 10. In this example, the AESA cards 100 are arranged in a 4×4 array. Though FIGS. 1A and 1B depict AESA cards 100 that are in a shape of a rectangle, they may be constructed to be a circle, triangle or any polygon shape. Also, though the array 12 is in a shape of a square the array may be a rectangle, circle, triangle or any polygon arrangement. Further, the number of AESA cards 100 may be one to any number of AESA cards 100.

In other applications, one or more AESA cards 100 may be used on the side of naval vessels, on ground structures and so forth. As will be shown herein an AESA card 100 is a "building block" to building an AESA system.

Figure 2:
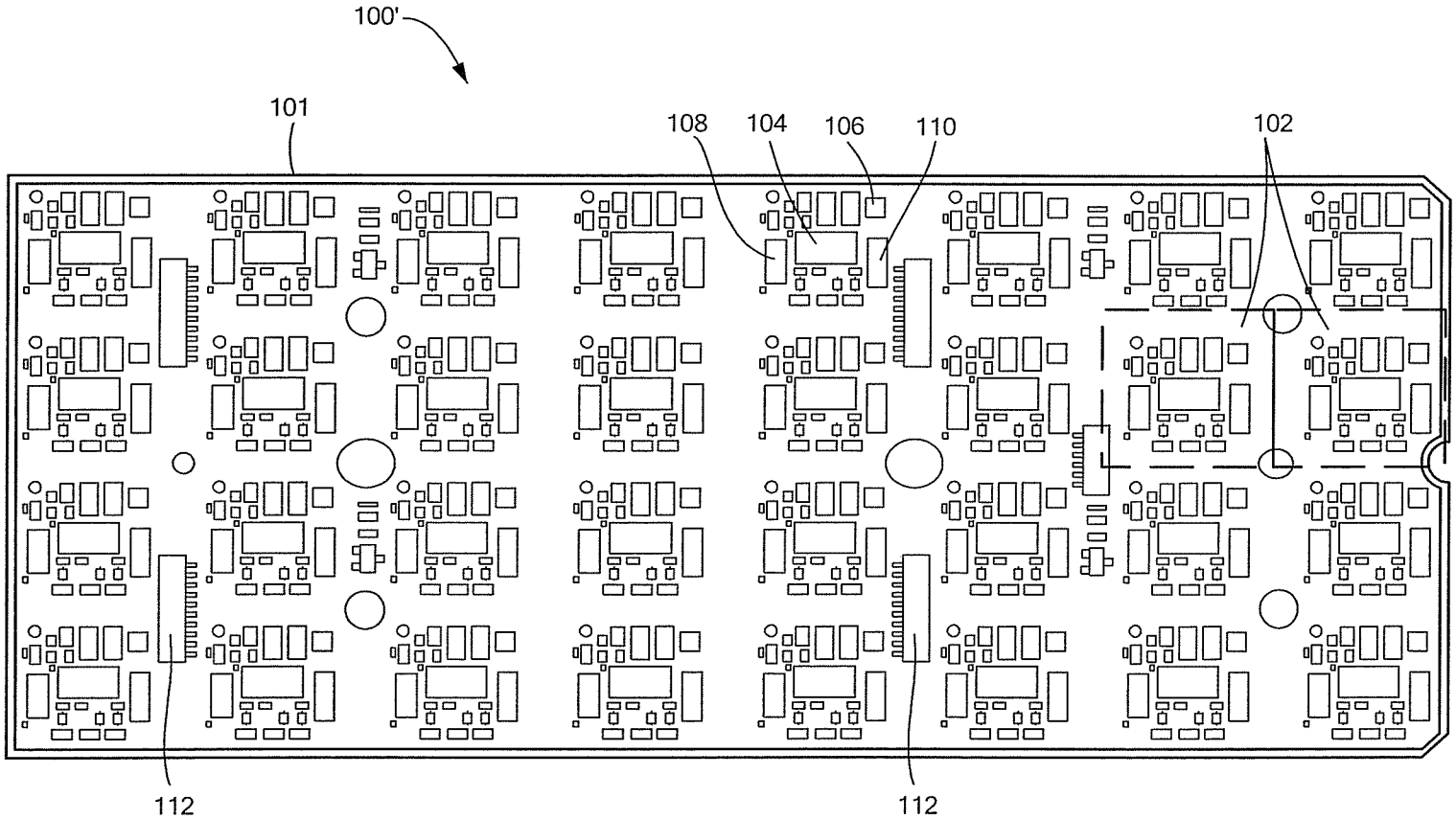
FIG. 2 is a diagram of an example of an AESA card with monolithic microwave integrated circuits (MMICs) disposed on the surface of the AESA card.
Figure 3:
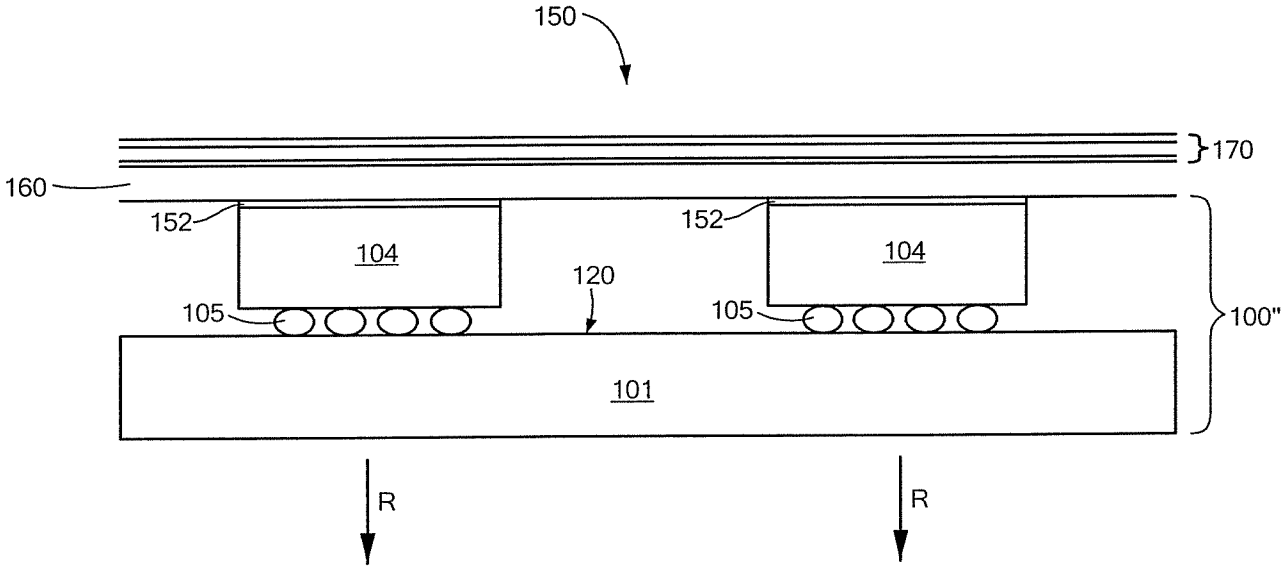
FIG. 3 is a cross-sectional view of an AESA assembly with an AESA card, MMICs and a cooling mechanism.

Referring to FIG. 2, an example of an AESA card 100 is an AESA card 100' that includes a printed wiring board (PWB) 101 and MMICs 104 (e.g., flip chips) on a surface of the PWB 101 (e.g., a surface 120 shown in FIG. 3). In this example, the AESA card 100' includes a 4×8 array of T/R channel cells 102 or 32 T/R channel cells 102. Each T/R channel cell 102 includes the MMICs 104, a drain modulator 106 (e.g., a drain modulator integrated circuit (IC)), a limiter and low noise amplifier (LNA) 108 (e.g., a gallium-arsenide (GaAs) LNA with limiter), a power amplifier 110 (e.g., a gallium-nitride (GaN) power amplifier). The AESA card 100' also includes one or more power and logic connectors 112. Though the T/R channel cells 102 are arranged in a rectangular array, the T/R channel cells 102 may be arranged in a circle, triangle or any type of arrangement.

Referring to FIG. 3, an AESA assembly 150 includes an AESA card (e.g., an AESA card 100") with the PWB 101 and MMICs 104 disposed on the surface 120 of the PWB 101 by solder balls 105. The AESA assembly 150 also includes a thermal spreader plate 160 coupled to each of the MMICs through thermal epoxy 152 and a cold plate 170. The cold plate 170 includes a channel 172 to receive a fluid such as a gas or a liquid to cool the MMICs 104. Thus, each MMIC 104 is heat sunk in parallel. That is, the thermal resistance from the heat source (e.g., MMICs 104) to the heat sink (cold plate 170) is the same for all MMICs 104 and components (e.g., the drain modulator 106, the LNA 108, the power amplifier 110 and so forth) in each T/R channel cell 102 across the AESA card 100" thereby reducing the thermal gradient between T/R channel cells 102. The AESA card 100" radiates RF signals in the R direction.

Figure 4:
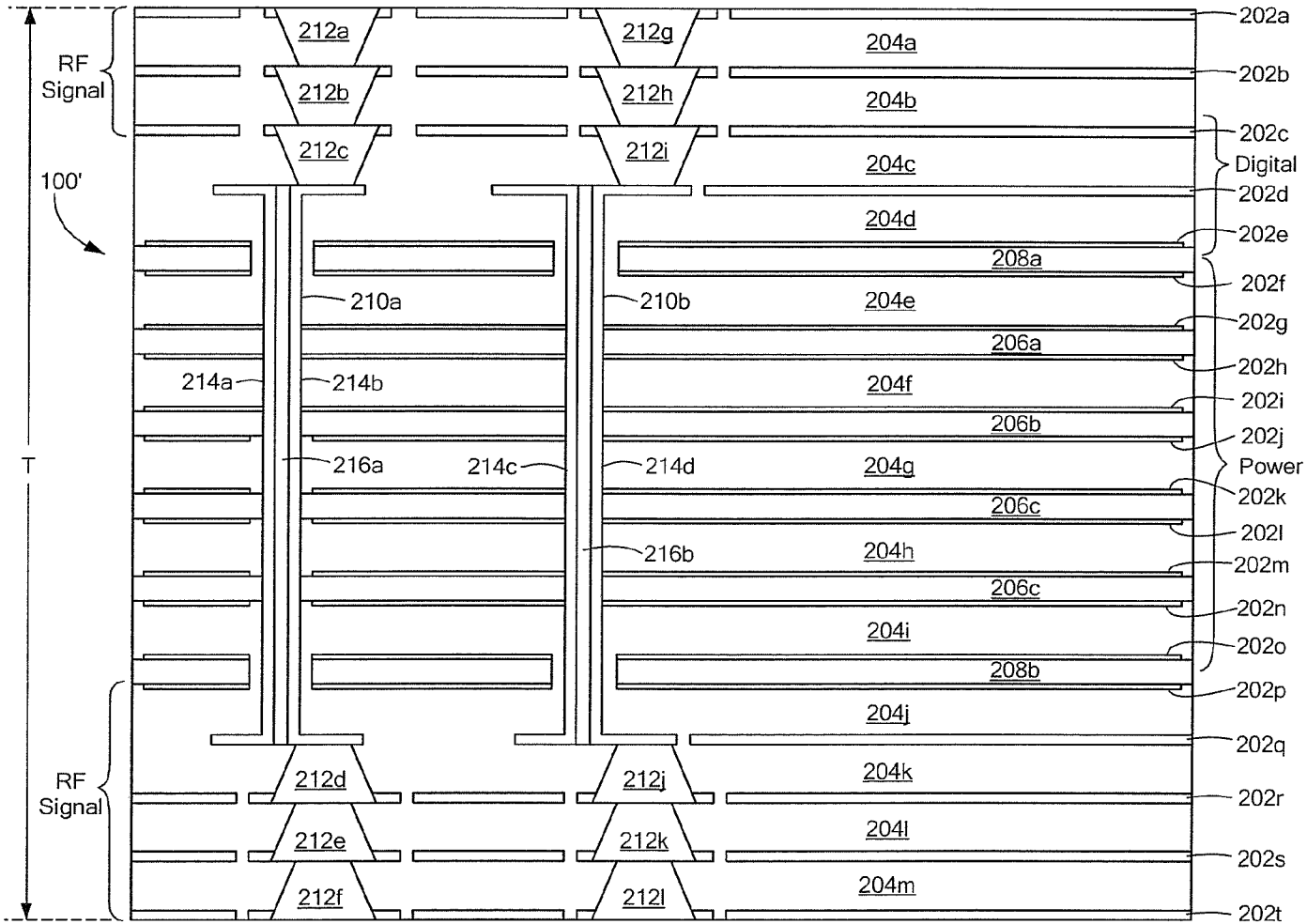
FIG. 4 is a cross-sectional view of a printed wiring board (PWB).

Referring to FIG. 4, an example of a printed wiring board (PWB) 101 is a PWB 101'. In one example, the thickness, t of the PWB 101' is about 64 mils.

The PWB 101' includes metal layers (e.g., metal layers 202*a*-202*t*) and one of an epoxy-resin layer (e.g., epoxy-resin layers 204*a*-204*m*), a polyimide dielectric layer (e.g., polyimide dielectric layers 206*a*-206*d*) or a composite layer (e.g., composite layers 208*a*, 208*b*) disposed between each of the metal layers (202*a*-202*t*). In particular, the composite layer 208*a* is disposed between the metal layers 210*e*, 210*f* and the composite layer 208*b* is disposed between the metal layers 210*o*, 210*p*. The polyimide dielectric layer 206*a* is disposed between the metal layers 202*g*, 202*h*, the polyimide dielectric layer 206*b* is disposed between the metal layers 202*i*, 202*j*, the polyimide dielectric layer 206*c* is disposed between the metal layers 202*k*, 202*l* and the polyimide dielectric layer 206*d* is disposed between the metal layers 202*m*, 202*n*. The remaining metals layers include an epoxy-resin layer (e.g., one of epoxy-resin layers 204*a*-204*m*) disposed between the metal layers as shown in FIG. 4.

The PWB 101' also includes RF vias (e.g., RF vias 210*a*, 210*b*) coupling the metal layer 202*d* to the metal layer 202*q*. Each of the RF vias 210*a*, 210*b* includes a pair of metal plates (e.g., the RF via 210*a* includes metal plates 214*a*, 214*b* and the RF via 210*b* includes metal plates 214*c*, 214*d*). The metal plates 214*a*, 214*b* are separated by an epoxy resin 216*a* and the metal plates 214*c*, 214*d* are separated by an epoxy resin 216*b*. Though not shown in FIG. 4, one of ordinary skill in the art would recognize that other type vias exist for the digital logic layers and the power layers to bring these signals to a surface of the AESA card 100" or to other metal layers.

The PWB 101' also includes metal conduits (e.g., metal conduits 212*a*-212*l*) to electrically couple the RF vias 210*a*, 210*b* to the metal layers 202*a*, 202*t*. For example, the metal conduits 212*a*-212*c* are stacked one on top of the other with the metal conduit 212*a* coupling the metal layer 202*a* to the metal layer 202*b*, the metal conduit 212*b* coupling the metal layer 202*b* to the metal layer 202*c* and the metal conduit 212*c* coupling the metal layer 202*c* to the metal layer 202*d* and to the RF via 210*a*. The metal conduits 212*a*-212*l* are formed by drilling holes (e.g., about 4 or 5 mils in diameter) into the PWB 101' and filling the holes with a metal.

Further, the metal conduits 212*d*-212*f* are stacked one on top of the other with the metal conduit 212*d* coupling the metal layer 202*r* and the RF via 210*a* to the metal layer 202*s*, the metal conduit 212*e* coupling the metal layer 202*s* to the metal layer 202*t* and the metal conduit 212*f* coupling the metal layer 202*t* to the metal layer 202*u*.

The metal layers 202*a*-202*c* and the epoxy-resin layers 204*a*-204*b* are used to distribute RF signals. The metal layers 202*p*-202*t*, the epoxy-resin layers 204*j*-204*m* are also used to distribute RF signals. The metal layers 202*c*-202*e* and the epoxy-resin layers 204*c*-204*d* are used to distribute digital logic signals. The metal layers 202*f*-202*o*, the epoxy-resin layers 204*e*-204*i* and the polyimide dielectric layers 206*a*-206*d* are used to distribute power.

In one example, one or more of the metal layers 202*a*-202*r* includes copper. Each of metal layers 202*a*-202*t* may vary in thickness from about 0.53 mils to about 1.35 mils, for example. In one example the RF vias 210*a*, 210*b* are made of copper. In one example, the metal conduits 212*a*-212*l* are made of copper.

In one example, each of the epoxy-resin layers 204*a*-204*m* includes a high-speed/high performance epoxy-resin material compatible with conventional FR-4 processing and has mechanical properties that make it a lead-free assembly compatible to include: a glass transition temperature, Tg, of about 200° C. (Differential scanning calorimetry (DSC)), a coefficient of thermal expansion (CTE)<Tg 16, 16 & 55 ppm/° C. and CTE>Tg 18, 18 & 230 ppm/° C. The low CTE and a high Td (decomposition temperature) of 360° C. are also advantageous in the sequential processing of the stacked metal conduits 212*a*-212*l*. Each of the epoxy-resin layers 204*a*-204*m* may vary in thickness from about 5.6 mils to about 13.8 mils, for example. In one particular example, the epoxy-resin material is manufactured by Isola Group SARL under the product name, FR408HR. In one example, the epoxy resin 216*a*, 216*b* is the same material used for the epoxy-resin layers 204*a*-204*m*.

In one example, each of the polyimide dielectric layers 206*a*-206*d* includes a polyimide dielectric designed to function as a power and ground plane in printed circuit boards for power bus decoupling and provides EMI and power plane impedance reduction at high frequencies. In one example, each of the polyimide dielectric layers is about 4 mils. In one particular example, the polyimide dielectric is manufactured by DUPONT® under the product name, HK042536E.

In one example, each of the composite layers 208*a*, 208*b* includes a composite of epoxy resin and carbon fibers to provide CTE control and thermal management. In one example, the composite layers may be function as a ground plane and also may function as a mechanical restraining layer. In one example, each of the composite layers is about 1.8 mils. In one particular example, the composite of epoxy resin and carbon fibers is manufactured by STABLCOR® Technology, Inc. under the product name, ST10-EP387.

In one example, the materials described above with respect to fabricating an AESA card are lead-free. Thus, the solution proposed herein is meets environmental regulations requiring products that are lead-free.

The processes described herein are not limited to the specific embodiments described. Elements of different embodiments described herein may be combined to form other embodiments not specifically set forth above. Other embodiments not specifically described herein are also within the scope of the following claims.

What is claimed is:

1. An active electronically scanned array (AESA) card comprising:

a printed wiring board (PWB) comprising:

a first set of metal layers used to provide RF signal distribution;

a second set of metal layers used to provide digital logical distribution;

a third set of metal layers used to provide power distribution; and a fourth set of metal layers used to provide RF signal distribution, wherein the PWB comprises at least one transmit/receive (T/R) channel used in an AESA.

2. The AESA card of claim 1 wherein the PWB further comprises:

a first composite layer of carbon fibers and epoxy between a metal layer of the second set of metal layers and a metal layer of the third set of metal layers; and a second composite layer of carbon fibers and epoxy between a metal layer of the third set of metal layers and a metal layer of the fourth set of metal layers.

3. The AESA card of claim 2 wherein the PWB further comprises:

a layer of epoxy resin between two metal layers of the first set of metal layers;

a layer of epoxy resin between two metal layers of the second set of metal layers; and a layer of epoxy resin between two metal layers of the third set of metal layers.

4. The AESA card of claim 2 wherein the PWB further comprises a layer of polyimide dielectric between two metal layers of the third set of metal layers.

5. The AESA card of claim 1, further comprising one or more monolithic microwave integrated circuits (MMICs) disposed on the surface of the PWB.

6. The AESA card of claim 1 wherein the MMICs are attached to the PWB using solder balls.

7. The AESA card of claim 1 wherein the PWB further comprises:

a plurality of metal conduits, each electrical conduit coupling one of the plurality of layers to another one of the plurality of layers.

8. The AESA card of claim 7 wherein the PWB further comprises an RF via having a first end coupled to a first metal conduit of the plurality of metal conduits and a second end opposite to the first end coupled to a second metal conduit of the plurality of metal conduits, wherein the RF via extends through the third set of metal layers used for power distribution from the first set of metal layers used to provide RF signal distribution to the second set of metal layers used to provide digital logical distribution without extending through the fourth set of metal layers used to provide RF signal distribution.

9. The AESA card of claim 1 wherein the PWB further comprises:

a layer of epoxy resin between two metal layers of the first set of metal layers;

a layer of epoxy resin between two metal layers of the second set of metal layers;

a layer of epoxy resin between two metal layers of the third set of metal layers; and a layer of polyimide dielectric between two metal layers of the third set of metal layers.

10. The AESA card of claim 1 wherein the AESA card does not include wire bonds.

11. An active electronically scanned array (AESA) assembly comprising:

an AESA card comprising:

a printed wiring board (PWB) comprising:

a first set of metal layers used to provide RF signal distribution;

a second set of metal layers used to provide digital logical distribution;

a third set of metal layers used to provide power distribution;

a fourth set of metal layers used to provide RF signal distribution; and one or more monolithic microwave integrated circuits (MMICs) disposed on the surface of the PWB, wherein the PWB comprises at least one transmit/receive (T/R) channel used in an AESA.

12. The ASEA assembly of claim 11, further comprising a cooling mechanism in contact with the one or more of the MMICs.

13. The ASEA assembly of claim 12 wherein the cooling mechanism comprises:

a thermal heat spreader in contact with the MMICs; and a cold plate in contact with the thermal spreader.

14. The ASEA assembly of claim 13 wherein the MMICs are attached to the PWB using solder balls.

15. The ASEA assembly of claim 11 wherein the PWB further comprises:

a plurality of metal conduits, each electrical conduit coupling one of the plurality of layers to another one of the plurality of layers.

16. The ASEA assembly of claim 15 wherein the PWB further comprises a via having a first end coupled to a first metal conduit of the plurality of metal conduits and a second end opposite to the first end connected to a second metal conduit of the plurality of metal conduits, wherein the via extends through the third set of metal layers used for power distribution from the first set of metal layers used to provide RF signal distribution to the second set of metal layers used to provide digital logical distribution without extending through the fourth set of metal layers used to provide RF signal distribution.

17. The ASEA assembly of claim 11 wherein the PWB further comprises:

a first composite layer of carbon fibers and epoxy between a metal layer of the second set of metal layers and a metal layer of the third set of metal layers; and a second composite layer of carbon fibers and epoxy between a metal layer of the third set of metal layers and a metal layer of the fourth set of metal layers.

18. The ASEA assembly of claim 17 wherein the PWB further comprises:

a layer of epoxy resin between two metal layers of the first set of metal layers;

a layer of epoxy resin between two metal layers of the second set of metal layers;

a layer of epoxy resin between two metal layers of the third set of metal layers; and a layer of polyimide dielectric between two metal layers of the third set of metal layers.

19. The ASEA assembly of claim 11 wherein the AESA card does not include wire bonds.

20. An active electronically scanned array (AESA) card comprising:

a printed wiring board (PWB) comprising:

a first set of metal layers used to provide RF signal distribution;

a second set of metal layers used to provide digital logical distribution;

a third set of metal layers used to provide power distribution; and a fourth set of metal layers used to provide RF signal distribution, one or more monolithic microwave integrated circuits (MMICs) disposed on the surface of the PWB;

a plurality of metal conduits, each electrical conduit coupling one of the plurality of layers to another one of the plurality of layers; and an RF via having a first end coupled to a first metal conduit of the plurality of metal conduits and a second end opposite to the first end coupled to a second metal conduit of the plurality of metal conduits, wherein the RF via extends through the third set of metal layers used for power distribution from the first set of metal layers used to provide RF signal distribution to the second set of metal layers used to provide digital logical distribution without extending through the fourth set of metal layers used to provide RF signal distribution, wherein the PWB comprises at least one transmit/receive (T/R) channel used in an AESA, and wherein the AESA card does not include wire bonds.

* * * * *